US006469670B2

(12) United States Patent
Ito

(10) Patent No.: US 6,469,670 B2
(45) Date of Patent: Oct. 22, 2002

(54) ANTENNA DEVICE AND PORTABLE RADIO COMMUNICATION DEVICE

(75) Inventor: Hiroki Ito, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/898,145

(22) Filed: Jul. 3, 2001

(65) Prior Publication Data

US 2002/0014994 A1 Feb. 7, 2002

(30) Foreign Application Priority Data

Jul. 5, 2000 (JP) ..... 2000-204329

(51) Int. Cl.[7] ..... H01Q 1/24
(52) U.S. Cl. ..... 343/702; 343/841; 343/851
(58) Field of Search ..... 343/700 MS, 702, 343/841, 851, 846

(56) References Cited

U.S. PATENT DOCUMENTS 4,965,408 A * 10/1990 Chapman et al. ..... 174/35 MS
5,530,919 A * 6/1996 Tsuru et al. ..... 455/128
5,826,201 A * 10/1998 Gratias ..... 343/702
6,088,603 A * 7/2000 Wilson ..... 343/702
6,157,546 A * 12/2000 Petty et al. ..... 174/35 R
6,246,373 B1 * 6/2001 Aoki ..... 343/702
6,259,896 B1 * 7/2001 Sepponen ..... 455/117
6,326,924 B1 * 12/2001 Muramoto et al. .. 343/700 MS

* cited by examiner

*Primary Examiner*—Tan Ho
*Assistant Examiner*—Shih-Chao Chen
(74) *Attorney, Agent, or Firm*—Jay H. Maioli

(57) ABSTRACT

Reducing the maximum value of the local average SAR to be absorbed into a human body without forming a short circuit between the conductive plate and the ground conductor is accomplished in a portable radio communication device 1 that includes a circuit board necessary for performing radio communication, a shield case 2 functioning as a ground conductor that shields the circuit board, a conductive plate 3, an antenna feeding portion 4, and an antenna 5. The circuit board, shield case 2, and conductive plate 3 are enclosed by a housing made of nonconductive material. The conductive plate 3 has its both ends along the longitudinal direction electrically opened from the shield case 2.

12 Claims, 2 Drawing Sheets

ANTENNA DEVICE AND PORTABLE RADIO COMMUNICATION DEVICE

BACKGROUND OF THE INVENTION

1. Field of the Invention

The present invention relates to an antenna device and a portable radio communication device, and particularly to an antenna device and a portable radio communication device capable of reducing electromagnetic waves which are generated therefrom and are to be absorbed into a human body.

2. Description of Related Art

Recently, portable data transmitting/receiving devices capable of transmitting/receiving information by radio communication are significantly developed. Of the portable data transmitting/receiving devices, portable radio communication devices for use in the PHS (Personal Handyphone System) system are spreading rapidly.

The portable radio communication device usually has an antenna for transmitting/receiving signals. Actually, the portable radio communication device itself works as an antenna, and the main body of the portable radio communication device other than the antenna portion also generates electromagnetic waves. So, it is required that, of the electromagnetic waves generated from the portable radio communication device, those to be absorbed into a human body should be suppressed. Specifically, of the electromagnetic waves generated from the portable radio communication device in use, amount of electromagnetic waves to be absorbed into a specific portion of a human body, particularly a head portion, per unit-time per unit-weight is defined as local average SAR (Specific Absorption Rate), and the maximum value of the local average SAR is required to be not more than a prescribed value.

To reduce the maximum value of the local average SAR to be absorbed into a human body, a conductive plate of a predetermined shape may be used. In this case, the conductive plate has its one end connected to a ground conductor which works as an antenna to form a short circuit, and has its other end electrically released from the ground conductor. As a result, input impedance of the electrically released end becomes approximately infinite. At this time, high-frequency current flowing to the ground conductor is suppressed, and thus amount of radiation of the electromagnetic waves is reduced.

FIG. 1 shows a schematic view of a portable radio communication device 20, which can reduce the maximum value of the local average SAR. The portable radio communication device 20 includes a circuit board (not shown) necessary for performing radio communication, shield case 21 as a ground conductor which shields the circuit board, a conductive plate 22, an antenna feeding portion 23, and an antenna 24. The circuit board, shield case 21, and conductive plate 22 are enclosed by a housing (not shown) made of nonconductive material. The conductive plate 22 and shield case 21 are connected by a conductor 25 to form a short circuit.

Since the circuit board is shielded by the shield case 21, various circuits including a transmitting/receiving circuit for communicating with a base station which are mounted on the circuit board do not have bad effects upon each other, and also do not have bad effects upon the antenna 24 and other devices.

The transmitting/receiving circuit on the circuit board in the shield case 21 generates transmission signals of a predetermined signal form, and sends the transmission signals to the antenna 24 via the antenna feeding portion 23. Then, the antenna 24 transmits the transmission signals to the base station. The antenna 24 receives reception signals from the base station, and sends the reception signals to the transmitting/receiving circuit via the antenna feeding portion 23. Then, the transmitting/receiving circuit performs processing for the reception signals such as demodulating.

The antenna 24 is a rod antenna made of conductive wire materials, or a helical antenna made of conductive wire materials wound spirally. Otherwise, the antenna 24 may be an antenna of various types such as a stretch type antenna combining the rod antenna and helical antenna. When the portable radio communication device 20 performs radio communication, since the high-frequency current flows to the shield case 21 via the antenna feeding portion 23, not only the antenna 24 but also the shield case 21 as a ground conductor for the circuit board works as an antenna. That is, whole the portable radio communication device 20 works as an antenna.

When the portable radio communication device 20 is used, the user comes into contact with a speaker of the portable radio communication device 20. Since the shield case 21 as a ground conductor for the circuit board located behind the speaker also works as an antenna and radiates electromagnetic waves, there will be formed a portion where the value of the local average SAR becomes maximum around an ear of the user which comes into contact with the speaker, and this portion will be referred to as a hot spot.

The portable radio communication device 20 has the conductive plate 22 arranged such that the speaker (not shown) faces the conductive plate 22, and the conductive plate 22 and a front surface 21*a* of the shield case 21 are approximately parallel with each other with a slight interval therebetween. The interval between the conductive plate 22 and the front surface 21*a* of the shield case 21 depends on a radio communication frequency, and the portable radio communication device 20 can adjust the frequency bandwidth in accordance with the interval.

The conductive plate 22 has its one end along the longitudinal direction connected to the shield case 21 to form a short circuit via the conductor 25, and has its other end electrically released from the shield case 21. The length L3 between the short circuit forming end and the electrically released end is set to be a quarter of the radio communication frequency.

Accordingly, the impedance between the conductive plate 22 and the shield case 21 becomes close to zero at the short circuit forming end, while becoming approximately infinite at the electrically released end. Thus, the high-frequency current has difficulty in flowing from the antenna feeding portion 23 to the conductive plate 22 and the shield case 21.

As has been described, as an example to reduce the maximum value of the local average SAR to be absorbed into a human body, the portable radio communication device 20 mounts a conductive plate 22 thereto, and reduces the amount of radiation of the electromagnetic waves from the conductive plate 22 and shield case 21. Thus, the local average SAR of the hot spot can be reduced.

So as to form a short circuit surely between the conductive plate 22 and the shield case 21 of the portable radio communication device 20, the configuration of the short circuit forming end becomes complicated since, for example, the conductor 25 has to have elasticity. Thus, such configuration leads to high production cost and growth of weight caused by increase of the number of parts etc.

SUMMARY OF THE INVENTION

It is therefore an object of the present invention to overcome the above-mentioned drawbacks by providing an antenna device and a portable radio communication device which can reduce the maximum value of the local average SAR to be absorbed into a human body without forming a short circuit between the conductive plate and the ground conductor.

According to the present invention, there is provided an antenna device having an antenna element and a ground conductor which work as an antenna, in which the antenna element is fed via an antenna feeding portion and high-frequency current flows to the ground conductor via the antenna feeding portion, the antenna device including:

high-frequency current suppressing means being a conductive plate of a predetermined shape which has its both ends along one direction electrically opened from the ground conductor.

Furthermore, according to the present invention, there is provided a portable radio communication device which has an antenna device having an antenna element and a ground conductor which work as an antenna, in which the antenna element is fed via an antenna feeding portion and high-frequency current flows to the ground conductor via the antenna feeding portion, wherein a circuit board for transmitting/receiving signals is shielded by the ground conductor, and wherein the antenna device includes high-frequency current suppressing means being a conductive plate of a predetermined shape which has its both ends along one direction electrically opened from the ground conductor.

The longitudinal length of the conductive plate is an integer multiple of half a wavelength at the frequency of the radio communication.

These objects and other objects, features and advantages of the present intention will become more apparent from the following detailed description of the preferred embodiments of the present invention when taken in conjunction with the accompanying drawings.

DESCRIPTION OF THE PREFERRED EMBODIMENTS

Preferred embodiments according to the present invention will further be described below with reference to the accompanying drawings.

The portable radio communication device according to the present invention has mounted thereto a conductive plate whose longitudinal length is set to be half the radio communication frequency. Thus, of the electromagnetic waves generated from the portable radio communication device, the maximum value of the local average SAR to be absorbed into a specific portion of a human body can be reduced.

Figure 1:
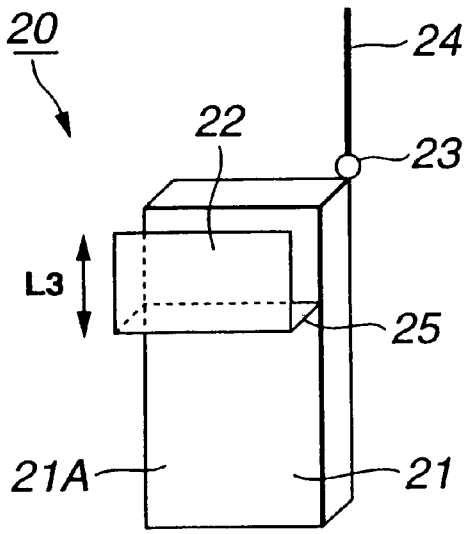
FIG.1 (PRIOR ART)
FIG. 1 shows a schematic view of a conductive plate mounted to the conventional portable radio communication device.
Figure 2:
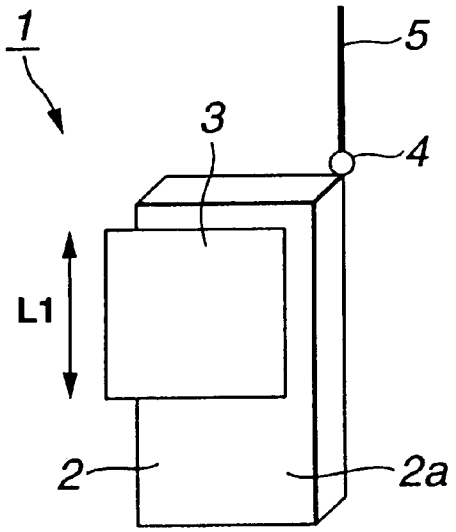
FIG. 2 shows a schematic view of a conductive plate mounted to a first embodiment of the portable radio communication device according to the present invention.

FIG. 2 shows a schematic view of a first embodiment of a portable radio communication device 1 according to the present invention. The portable radio communication device 1 includes a circuit board (not shown) necessary for performing radio communication, shield case 2 as a ground conductor which shields the circuit board, a conductive plate 3, an antenna feeding portion 4, and an antenna 5. The circuit board, shield case 2, and conductive plate 3 are enclosed by a housing (not shown) made of nonconductive material.

Since the circuit board is shielded by the shield case 2, various circuits including a transmitting/receiving circuit for communicating with a base station which are mounted on the circuit board do not have bad effects upon each other, and also do not have bad effects upon the antenna 5 and other devices.

The transmitting/receiving circuit on the circuit board in the shield case 2 generates transmission signals of a predetermined signal form, and sends the transmission signals to the antenna 5 via the antenna feeding portion 4. Then, the antenna 5 transmits the transmission signals to the base station. The antenna 5 receives reception signals from the base station, and sends the reception signals to the transmitting/receiving circuit via the antenna feeding portion 4. Then, the transmitting/receiving circuit performs processing for the reception signals such as demodulating.

The antenna 5 is a rod antenna made of conductive wire materials. When the portable radio communication device 1 performs radio communication, since the high-frequency current flows to the shield case 2 via the antenna feeding portion 4, not only the antenna 5 but also the shield case 2 as a ground conductor for the circuit board works as an antenna. That is, whole the portable radio communication device 1 works as an antenna.

As described above, the portable radio communication device 1 itself works as an antenna, and the main body of the portable radio communication device 1 other than the antenna 5 portion generates electromagnetic waves. So, it is required that electromagnetic waves to be absorbed into a human body should be suppressed. Specifically, of the electromagnetic waves generated from the portable radio communication device 1, amount of electromagnetic waves to be absorbed into a specific portion of a human body, particularly a head portion, per unit-time per unit-weight is defined as local average SAR (Specific Absorption Rate), and the maximum value of the local average SAR is required to be not more than a prescribed value.

Figure 3:
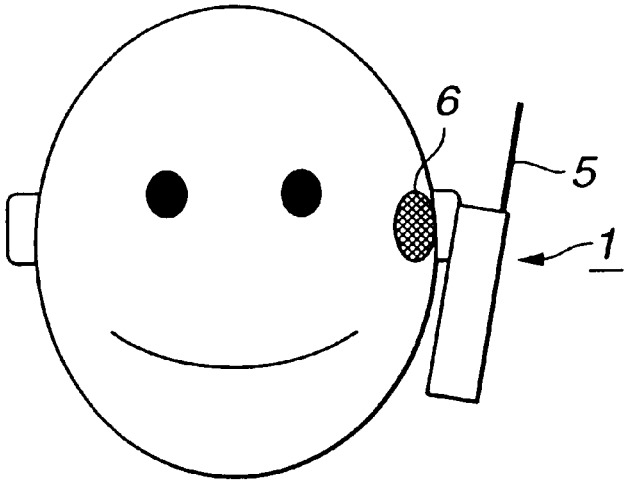
FIG. 3 shows a schematic view of a portion where the value of the local average SAR of the electromagnetic waves generated from the first and second embodiments of the portable radio communication device according to the present invention in use becomes maximum.

When the portable radio communication device 1 is used, the user comes into contact with a speaker, not shown, of the portable radio communication device 1, as schematically shown in FIG. 3. Since the shield case 2 as a ground conductor for the circuit board located behind the speaker also works as an antenna and radiates electromagnetic waves, there will be formed a portion where the value of the local average SAR becomes maximum around an ear of the user which comes into contact with the speaker, and this portion will be referred to as a hot spot 6.

So as to effectively reduce the maximum value of the local average SAR at the hot spot 6, the portable radio communication device 1 has the conductive plate 3 arranged such that the speaker (not shown) faces the conductive plate 3, and the conductive plate 3 and a front surface 2*a* of the shield case 2 are approximately parallel with each other with an appropriate interval therebetween, as shown in FIG. 2.

The conductive plate 3 is different from the conductive plate 22 of the portable radio communication device 20. The conductive plate 3 is not connected to the shield case 2, and has its both ends along the longitudinal direction electrically released from the shield case 2. The length L1 between the both electrically released ends of the conductive plate 3 is set to be half the radio communication frequency.

Accordingly, the impedance between the shield case 2 and the conductive plate 3 becomes approximately infinite at the both electrically released ends, while becoming close to zero at around the center portion of the conductive plate 3.

Thus, even though the conductive plate 3 is not connected to the shield case 2 and does not form a short circuit, since the impedance increases at the both electrically released ends, the high-frequency current has difficulty in flowing from the antenna feeding portion 4 to the conductive plate 3 and shield case 2. Thus, the radiation of the electromagnetic waves from the conductive plate 3 and shield case 2 at the time of using the portable radio communication device 1 is reduced, and the maximum value of the local average SAR of the hot spot 6 is reduced.

The interval between the conductive plate 3 and the front surface 2*a* of the shield case 2 depends on a radio communication frequency, and the portable radio communication device 1 can adjust the interval in accordance with the frequency bandwidth. The interval between the conductive plate 3 and the front surface 2*a* of the shield case 2 can easily be changed by inserting a spacer corresponding to a predetermined interval therebetween. The conductive plate 3 may be formed by applying a metal plating to the corresponding inner part of the housing which encloses the shield case 2.

Figure 4:
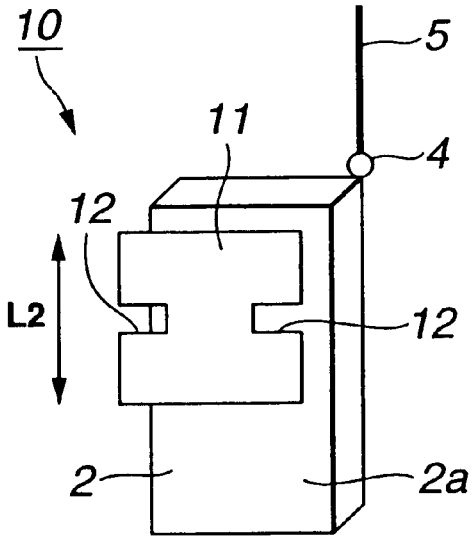
FIG. 4 shows a schematic view of a conductive plate mounted to a second embodiment of the portable radio communication device according to the present invention.

FIG. 4 shows a schematic view of a second embodiment of a portable radio communication device 10 according to the present invention. The basic configuration of the portable radio communication device 10 is similar to that of the portable radio communication device 1 shown in FIG. 2. Thus, the parts or components similar to those of the portable radio communication device 1 are indicated with the same reference numerals.

The portable radio communication device 10 includes a conductive plate 11 which also is not connected to the shield case 2, and has its both ends along the longitudinal direction electrically released from the shield case 2. The conductive plate 11 has two slits 12 at predetermined positions, as shown in FIG. 4. The length L2 between the both electrically released ends of the conductive plate 11 can be set shorter than the length L1 of the portable radio communication device 1 by providing the slits 12.

The slits 12 are provided such that the electrical length of the conductive plate 11 becomes half the radio communication frequency. The positions where the slits 12 are provided are not restricted to those shown in FIG. 4. Also, the configuration, depth and widths of the slits 12 are not restricted to those shown in FIG. 4. The slits 12 may be an opening slit which is provided by cutting off a predetermined shape from the conductive plate 11.

Furthermore, in the first and second embodiments, the portable radio communication devices 1, 10 are not provided with anything between the front surface 2*a* of the shield case 2 and conductive plates 3, 11. On the other hand, the portable radio communication devices 1, 10 may have inserted therein a dielectric having a predetermined relative dielectric constant between the front surface 2*a* of the shield case 2 and conductive plates 3, 11. In this case, The lengths L1, L2 between the both electrically released ends of the conductive plates 3, 11 can be set shorter due to wavelength-reducing effect corresponding to the relative dielectric constant of the dielectric.

When the dielectric is used, the length L between the both electrically released ends satisfy the following equation 1, in which λ represents a wavelength used in the radio communication and e represents the relative dielectric constant of the dielectric.

$$L = \frac{\lambda}{2} \cdot \frac{1}{\sqrt{\varepsilon}} \tag{1}$$

As described above, in this case, the lengths L1, L2 between the both electrically released ends of the conductive plates 3, 11 can be set shorter, which can reduce the portable radio communication devices 1, 10 in size.

In the portable radio communication devices 1 and 10, the antenna 5 is connected to the transmitting/receiving circuit. On the other hand, the antenna 5 may be connected to a transmitting circuit.

Furthermore, in the portable radio communication devices 1 and 10, the conductive plates 3 and 11 are of a rectangular shape. On the other hand, the present invention is not restricted as such. The conductive plate 3 of any shape can be used and similar effect can be obtained as long as the electrical lengths of the conductive plates 3 and 11 become half the radio communication frequency.

Furthermore, in the portable radio communication devices 1 and 10, the conductive plates 3 and 11 may be made of transparent or translucent conductive material and may be arranged on a front surface of a liquid crystal display.

The present invention in not restricted to the above mentioned embodiments, and various modifications can be possible without departing the spirit and scope of the invention.

As has been described heretofore, according to the present invention, there is provided an antenna device having an antenna element and a ground conductor which work as an antenna, in which the antenna element is fed via an antenna feeding portion and high-frequency current flows to the ground conductor via the antenna feeding portion. The antenna device includes high-frequency current suppressing means which is a conductive plate of a predetermined shape which has its both ends along one direction electrically released from the ground conductor.

The longitudinal length of the conductive plate is an integer multiple of half a wavelength at the frequency of the radio communication.

Such an antenna device can reduce the electromagnetic waves to be absorbed into a human body without forming a short circuit between the conductive plate and the ground conductor. Also, since the number of parts is reduced, it becomes possible to reduce production cost.

Furthermore, according to the present invention, there is provided a portable radio communication device which has an antenna device having an antenna element and a ground conductor which work as an antenna, in which the antenna element is fed via an antenna feeding portion and high-frequency current flows to the ground conductor via the antenna feeding portion. In the portable radio communication device, a circuit board for transmitting/receiving signals is shielded by the ground conductor. And the antenna device includes high-frequency current suppressing means which is a conductive plate of a predetermined shape which has its both ends along one direction electrically released from the ground conductor.

The longitudinal length of the conductive plate is an integer multiple of half a wavelength at the frequency of the radio communication.

Such a portable radio communication device can reduce the electromagnetic waves to be absorbed into a human body without forming a short circuit between the conductive plate and the ground conductor. Also, since the number of parts is reduced, it becomes possible to reduce production cost.

What is claimed is:

1. An antenna device having an antenna element and a ground conductor which work as an antenna, in which the antenna element is fed via an antenna feeding portion and high-frequency current flows to the ground conductor via the antenna feeding portion, the antenna device comprising:

high-frequency current suppressing means including a conductive plate of a predetermined shape and having both ends along one direction electrically opened from the ground conductor.

2. The antenna device as set forth in claim 1, wherein a longitudinal length of the conductive plate is an integer multiple of half a wavelength at a frequency of radio communication.

3. The antenna device as set forth in claim 1, wherein the conductive plate has one or more slits at predetermined respective positions.

4. The antenna device as set forth in claim 1, further comprising a dielectric having a predetermined relative dielectric constant inserted between the conductive plate and the ground conductor.

5. The antenna device as set forth in claim 4, wherein the conductive plate has one or more slits at predetermined respective positions.

6. The antenna device as set forth in claim 1, wherein the high-frequency current suppressing means is arranged facing a portion of the ground conductor where an amount of electromagnetic waves generated by the high-frequency current flowing to the ground conductor where a maximum amount of electromagnetic waves generated by the high-frequency current flowing to the ground conductor is absorbed into a human body at a maximum.

7. A portable radio communication device that has an antenna device having an antenna element and a ground conductor that work as an antenna, in which the antenna element is fed via an antenna feeding portion and high-frequency current flows to the ground conductor via the antenna feeding portion, wherein a circuit board having a circuit for transmitting/receiving signals is shielded by the ground conductor, and wherein the antenna device comprises high-frequency current suppressing means including a conductive plate of a predetermined shape having both ends along one direction electrically opened from the ground conductor.

8. The portable radio communication device as set forth in claim 7, wherein a longitudinal length of the conductive plate is an integer multiple of half a wavelength at a frequency of radio communication.

9. The portable radio communication device as set forth in claim 7, wherein the conductive plate has one or more slits at predetermined respective positions.

10. The portable radio communication device as set forth in claim 7, further comprising a dielectric having a predetermined relative dielectric constant inserted between the conductive plate and the ground conductor.

11. The portable radio communication device as set forth in claim 10, wherein the conductive plate has one or more slits at predetermined respective positions.

12. The portable radio communication device as set forth in claim 7, wherein the high-frequency current suppressing means is so facing a portion of the ground conductor where a maximum amount of electromagnetic waves generated by the high-frequency current flowing to the ground conductor is absorbed into a human body.

* * * * *